US010961962B2

(12) United States Patent
Nemoto et al.

(10) Patent No.: US 10,961,962 B2
(45) Date of Patent: Mar. 30, 2021

(54) HIGH-PRESSURE FUEL SUPPLY PUMP

(71) Applicant: Hitachi Automotive Systems, Ltd., Hitachinaka (JP)

(72) Inventors: Masashi Nemoto, Hitachinaka (JP); Shigehiko Omata, Hitachinaka (JP); Moritsugu Akiyama, Hitachinaka (JP); Shunsuke Aritomi, Tokyo (JP); Takanori Oginuma, Hitachinaka (JP)

(73) Assignee: Hitachi Automotive Systems, Ltd., Hitachinaka (JP)

( * ) Notice: Subject to any disclaimer, the term of this patent is extended or adjusted under 35 U.S.C. 154(b) by 217 days.

(21) Appl. No.: 16/305,303

(22) PCT Filed: Jun. 5, 2017

(86) PCT No.: PCT/JP2017/020790
§ 371 (c)(1),
(2) Date: Nov. 28, 2018

(87) PCT Pub. No.: WO2018/003415
PCT Pub. Date: Jan. 4, 2018

(65) Prior Publication Data

US 2020/0318593 A1 Oct. 8, 2020

(30) Foreign Application Priority Data

Jun. 27, 2016 (JP) ..... JP2016-126171

(51) Int. Cl.
*F02M 1/00* (2006.01)
*F02M 59/46* (2006.01)

(52) U.S. Cl.
CPC ..... *F02M 59/46* (2013.01)

(58) Field of Classification Search
CPC .. F02M 59/36; F02M 59/462; F02M 63/0054; F02M 59/46; F02M 59/44; F02M 2200/04; Y10T 137/7848
(Continued)

(56) References Cited

U.S. PATENT DOCUMENTS

2006/0185647 A1 8/2006 Rapp
2008/0056914 A1* 3/2008 Usui ..... F02M 59/367 417/307
(Continued)

FOREIGN PATENT DOCUMENTS

CN 101294530 A 10/2008
CN 101614173 A 12/2009
(Continued)

OTHER PUBLICATIONS

Extended European Search Report issued in counterpart European Application No. 17819780.2 dated Jan. 23, 2020 (seven (7) pages).
(Continued)

*Primary Examiner* — John Kwon
(74) *Attorney, Agent, or Firm* — Crowell & Moring LLP

(57) ABSTRACT

There is provided a discharge valve mechanism provided at an outlet of a pressurizing chamber of a high-pressure fuel supply pump that aims to reduce a backflow amount of fuel from a discharge valve and to prevent cavitation erosion. There are provided a discharge valve disposed on a discharge side of a pressurizing chamber, a discharge valve seat that closes a discharge side flow passage of the pressurizing chamber by seating the discharge valve, and a discharge valve spring that presses the discharge valve toward the discharge valve seat. It is configured such that, in a case where a minimum seat diameter of a seat portion in which the discharge valve is seated on the discharge valve seat is set to D and a spring force of the discharge valve spring at
(Continued)

a time of setting is set to F, a coefficient K obtained by dividing the spring force F by the minimum seat diameter D is set to be 0.2 or more.

6 Claims, 3 Drawing Sheets

(58) Field of Classification Search
USPC ..... 137/513.5; 417/559; 123/510, 511
See application file for complete search history.

(56) References Cited

U.S. PATENT DOCUMENTS

| | | | | |
|---|---|---|---|---|
| 2008/0257989 | A1 | 10/2008 | Ricco et al. | |
| 2009/0321542 | A1 | 12/2009 | Ricco et al. | |
| 2011/0123376 | A1 | 5/2011 | Aritomi et al. | |
| 2012/0227711 | A1 | 9/2012 | Saito | |
| 2013/0306166 | A1 | 11/2013 | Erb | |
| 2015/0322908 | A1 | 11/2015 | Avireddi | |
| 2017/0306905 | A1* | 10/2017 | Usui | F02M 59/44 |
| 2017/0356412 | A1* | 12/2017 | Akiyama | F02M 59/36 |
| 2018/0135579 | A1* | 5/2018 | Kusakabe | F02M 51/00 |
| 2019/0316558 | A1* | 10/2019 | Hayatani | F02M 63/005 |
| 2020/0132029 | A1* | 4/2020 | Akiyama | F02M 59/46 |
| 2020/0248663 | A1* | 8/2020 | Tokuo | F02M 59/445 |

FOREIGN PATENT DOCUMENTS

| | | | |
|---|---|---|---|
| CN | 102325987 | A | 1/2012 |
| CN | 104302907 | A | 1/2015 |
| EP | 2 302 195 | A1 | 3/2011 |
| JP | 2-28565 | U | 2/1990 |
| JP | 2002-227746 | A | 8/2002 |
| JP | 2002-250258 | A | 9/2002 |
| JP | 2003-97385 | A | 4/2003 |
| JP | 2010-112303 | A | 5/2010 |
| JP | 2011-80391 | A | 4/2011 |
| JP | 5180365 | B2 | 4/2013 |
| JP | 2014-148980 | A | 8/2014 |

OTHER PUBLICATIONS

International Search Report (PCT/ISA/210) issued in PCT Application No. PCT/JP2017/020790 dated Aug. 15, 2017 with English translation (four (4) pages).

Japanese-language Written Opinion (PCT/ISA/237) issued in PCT Application No. PCT/JP2017/020790 dated Aug. 15, 2017 (five (5) pages).

Chinese-language Office Action issued in Chinese Application No. 201780030010.1 dated Apr. 2, 2020 with English translation (10 pages).

* cited by examiner

HIGH-PRESSURE FUEL SUPPLY PUMP

TECHNICAL FIELD

The present invention relates to a discharge valve mechanism of a high-pressure fuel supply pump that supplies fuel to an engine at a high pressure.

BACKGROUND ART

In JP 2011-80391 A, there has been disclosed a high-pressure fuel pump having a discharge valve mechanism that includes a discharge valve member, a valve seat member, a discharge valve spring, and a valve holding member coupled to the valve seat member to surround a seat surface and the discharge valve spring, the valve holding member in which a valve housing is formed.

CITATION LIST

Patent Literature

PTL 1: JP 2011-80391 A
PTL 2: JP 5180365 B2

SUMMARY OF INVENTION

Technical Problem

In the configuration of the discharge valve mechanism including the valve holding member formed to house the valve inside thereof, according to JP 2011-80391 A, although the discharge valve spring is described for the purpose of pressing the discharge valve member toward the seat surface of the valve seat member using the reference sign 8*c*, there is no detailed reference to a spring load of the discharge valve spring.

After fuel discharge is finished (when the discharge valve is closed), a fuel pressure inside a discharge port is lowered due to a plunger moving downward. On the other hand, a fuel pressure on a fuel discharge valve side increases. However, when the spring load is insufficient, a pressure difference across the discharge valve is generated, whereby the fuel once discharged flows backward, resulting in a reduction in a discharge flow rate. At the same time, when the fuel once discharged flows backward into the pressurizing chamber, cavitation occurs, and a problem may be raised in that a discharge member and the valve seat member are damaged (hereinafter referred to as cavitation erosion) when the cavitation collapses.

In view of the above, an object of the present invention is to provide a high-pressure fuel supply pump with high efficiency in which a discharge flow rate of a high-pressure fuel pump is increased by specifying spring force of a discharge valve spring by a coefficient K obtained using a minimum seat diameter D and suppressing a backflow amount of fuel once discharged flowing into a pressurizing chamber of the high-pressure fuel pump.

Solution to Problem

In order to achieve an object of the present invention, there is provided a high-pressure fuel supply pump, including: a discharge valve disposed on a discharge side of a pressurizing chamber; a discharge valve seat that closes a discharge side flow passage of the pressurizing chamber by seating the discharge valve; and a discharge valve spring that presses the discharge valve toward the discharge valve seat, in which in a case where a minimum seat diameter of a seat portion in which the discharge valve is seated on the discharge valve seat is set to D and a spring force of the discharge valve spring at a time of setting is set to F, a coefficient K obtained by dividing the spring force F by the minimum seat diameter D is set to be 0.2 or more.

Advantageous Effects of Invention

According to the present invention, by setting K to be 0.2 or more, the backflow rate of the fuel once discharged flowing into the pressurizing chamber of the high-pressure fuel pump can be suppressed, and the discharge flow rate of the high-pressure fuel pump can be increased. As a result, it becomes possible to provide a high-pressure fuel supply pump with high fuel consumption efficiency. In addition, since cavitation generated when the fuel once discharged flows backward into the pressurizing chamber can be suppressed, it also becomes possible to reduce damage on the discharge member and the valve seat member.

Moreover, since the high-pressure fuel supply pump uses power of an internal combustion engine as a power source, the operation efficiency of the high-pressure fuel pump can be improved, thereby reducing $CO_2$ emissions.

As described above, according to the present invention, a high-quality high-pressure fuel supply pump with low environmental load can be provided.

DESCRIPTION OF EMBODIMENTS

Hereinafter, an embodiment according to the present invention will be described.

First Embodiment

Hereinafter, a configuration and operation of a high-pressure fuel supply pump according to an embodiment of the present invention will be described with reference to FIGS. 1 to 5.

First, a configuration of a high-pressure fuel supply system using the high-pressure fuel supply pump according to the present embodiment will be described with reference to FIG. 1.

Figure 1:
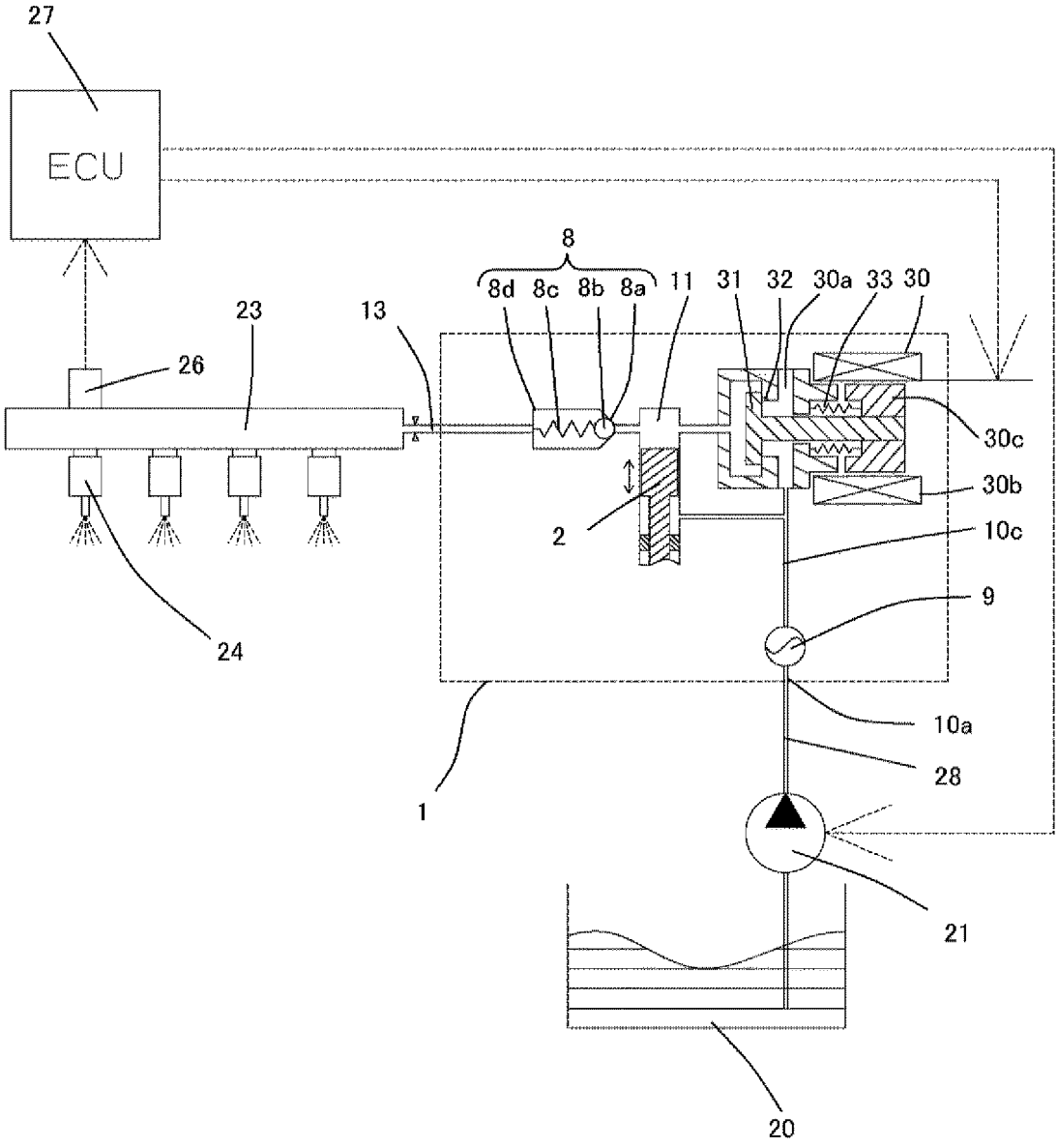
FIG. 1 is an exemplary fuel supply system using a high-pressure fuel supply pump according to an embodiment of the present invention.

FIG. 1 is an overall configuration diagram of the high-pressure fuel supply system using the high-pressure fuel supply pump according to the embodiment of the present invention. In FIG. 1, a portion surrounded by a dashed line illustrates a pump housing 1 of the high-pressure fuel supply pump. The high-pressure fuel supply pump according to the present embodiment is configured by integrally incorporating the mechanism and parts illustrated in the dashed line therein. In addition, a dotted line in the drawing illustrates a flow of an electric signal.

Fuel in a fuel tank 20 is pumped up by a feed pump 21 and sent to a fuel suction port 10*a* of the pump housing 1 via a suction pipe 28. The fuel having passed through the fuel suction port 10*a* reaches a suction port 30*a* of an electromagnetic suction valve mechanism 30 included in a displacement varying mechanism via a pressure pulsation reduction mechanism 9 and a suction passage 10*c*.

The electromagnetic suction valve mechanism 30 includes an electromagnetic coil 30*b*. An electromagnetic plunger 30*c* compresses a spring 33 and moves to a left side in FIG. 1 while the electromagnetic coil 30*b* is energized, and kept in that state. At this time, a suction valve body 31 attached to the tip of the electromagnetic plunger 30*c* opens a suction port 32 communicating with a pressurizing chamber 11 of the high-pressure fuel supply pump. When there is no fluid pressure difference between the suction passage 10*c* (suction port 30*a*) and the pressurizing chamber 11 while the electromagnetic coil 30*b* is not energized, the suction valve body 31 is pushed by biasing force of the spring 33 in the valve closing direction (right side in FIG. 1) so that the suction port 32 is closed, and kept in that state. FIG. 1 illustrates a state in which the suction port 32 is closed.

In the pressurizing chamber 11, a plunger 2 is held slidably in the vertical direction in FIG. 1. When the plunger 2 is displaced downward in FIG. 1 due to rotation of a cam of the internal combustion engine and is in a suction process, a capacity of the pressurizing chamber 11 increases and the fuel pressure inside thereof decreases. In this process, when the fuel pressure inside the pressurizing chamber 11 becomes lower than the pressure of the suction passage 10*c* (suction port 30*a*), valve opening force (force displacing the suction valve body 31 to the left in FIG. 1) is generated in the suction valve body 31 due to the fluid pressure difference of the fuel. Due to this valve opening force that surpasses the biasing force of the spring 33, the suction valve body 31 opens to open the suction port 32. In this state, when a control signal from an ECU 27 is applied to the electromagnetic suction valve mechanism 30, current flows through the electromagnetic coil 30*b* of an electromagnetic suction valve 30, the electromagnetic plunger 30*c* moves to the left side in FIG. 1 due to magnetic biasing force, and the suction port 32 is kept opened.

When the plunger 2 shifts from the suction process to a compression process (elevating process from a lower start point to an upper start point) while the electromagnetic suction valve mechanism 30 is kept in the state in which the input voltage is applied thereto, since the electromagnetic coil 30*b* is kept energized, the magnetic biasing force is maintained and the suction valve body 31 is still kept opened. While the capacity of the pressurizing chamber 11 decreases with compression movement of the plunger 2, in this state, the fuel once suctioned into the pressurizing chamber 11 is returned to the suction passage 10*c* (suction port 30*a*) again passing between the suction valve body 31 and the suction port 32 that are opened, whereby the pressure of the pressurizing chamber 11 does not increase. This process is referred to as a return process.

In the return process, when the electromagnetic coil 30*b* is deenergized, the magnetic biasing force applied to the electromagnetic plunger 30*c* is erased after a certain period of time (after magnetic or mechanical delay time). Then, the suction valve body 31 moves to the right side in FIG. 1 and closes the suction port 32 due to the biasing force of the spring 33 constantly working on the suction valve body 31 and fluid force generated by the pressure loss of the suction port 32. When the suction port 32 is closed, the fuel pressure inside the pressurizing chamber increases from this time as the plunger 2 moves up. When the fuel pressure inside the pressurizing chamber 11 exceeds the pressure larger than the fuel pressure of the discharge port 13 by a predetermined value, the fuel remaining in the pressurizing chamber 11 is discharged under high pressure and supplied to a common rail 23 through a discharge valve unit (discharge valve mechanism) 8. This process is referred to as a discharge process. As described above, the compression process of the plunger 2 consists of the return process and the discharge process.

The ECU 27 controls a timing of deenergization of the electromagnetic coil 30*b* of the electromagnetic suction valve mechanism 30, thereby controlling the amount of high-pressure fuel to be discharged.

In the pump housing 1, the discharge valve unit (discharge valve mechanism) 8 is provided between the pressurizing chamber 11 and the discharge port (discharge side pipe connection portion) 13 on the outlet side of the pressurizing chamber 11. The discharge valve unit (discharge valve mechanism) 8 consists of a valve seat member 8*a*, a discharge valve member 8*b*, a discharge valve spring 8*c*, and a valve holding member 8*d*. In a state where there is no fuel pressure difference between the pressurizing chamber 11 and the discharge port 13, the discharge valve member 8*b* is pressed against the valve seat member 8*a* by the biasing force of the discharge valve spring 8*c*, and is in a valve closed state. When the fuel pressure inside the pressurizing chamber 11 exceeds the pressure larger than the fuel pressure of the discharge port 13 by the predetermined value, the discharge valve member 8*b* resists the discharge valve spring 8*c* and opens, and the fuel inside the pressurizing chamber 11 is discharged to the discharge port 13 through the discharge valve unit (discharge valve mechanism) 8.

After the discharge valve member 8*b* opens, movement thereof is restricted when it comes into contact with a stopper 805 formed on the valve holding member 8*d*. Therefore, a stroke of the discharge valve member 8*b* is appropriately determined by the valve holding member 8*d*.

Further, when the discharge valve member 8*b* repeatedly opens and closes, it is guided by an interior wall 806 of the valve holding member 8*d* to move smoothly in the stroke direction. With the configuration described above, the discharge valve unit (discharge valve mechanism) serves as a check valve that restricts a fuel flowing direction. Detailed configuration of the discharge valve unit (discharge valve mechanism) 8 will be described later with reference to FIGS. 2 to 5, 7, and 11.

As described above, the fuel guided to the fuel suction port 10*a* is pressurized to a high pressure by reciprocation of the plunger 2 inside the pressurizing chamber 11 of the pump housing 1, and is pressure-fed from, through the discharge valve unit (discharge valve mechanism) 8, the discharge port 13 to the common rail 23 that is a high-pressure pipe.

Although an exemplary case of what is called a normally closed type solenoid valve that closes in a deenergized state and opens in an energized state has been described, contrary to this, what is called a normally opened type solenoid valve that opens in a deenergized state and closes in an energized state may be used. However, in this case, a flow rate control command from the ECU 27 is reversed between on and off.

An injector 24 and a pressure sensor 26 are mounted on the common rail 23. The injector 24 is mounted corresponding to the number of cylinders of the internal combustion engine. The injector 24 opens and closes in accordance with the control signal of the ECU 27, and injects a predetermined amount of fuel into the cylinder.

Figure 2:
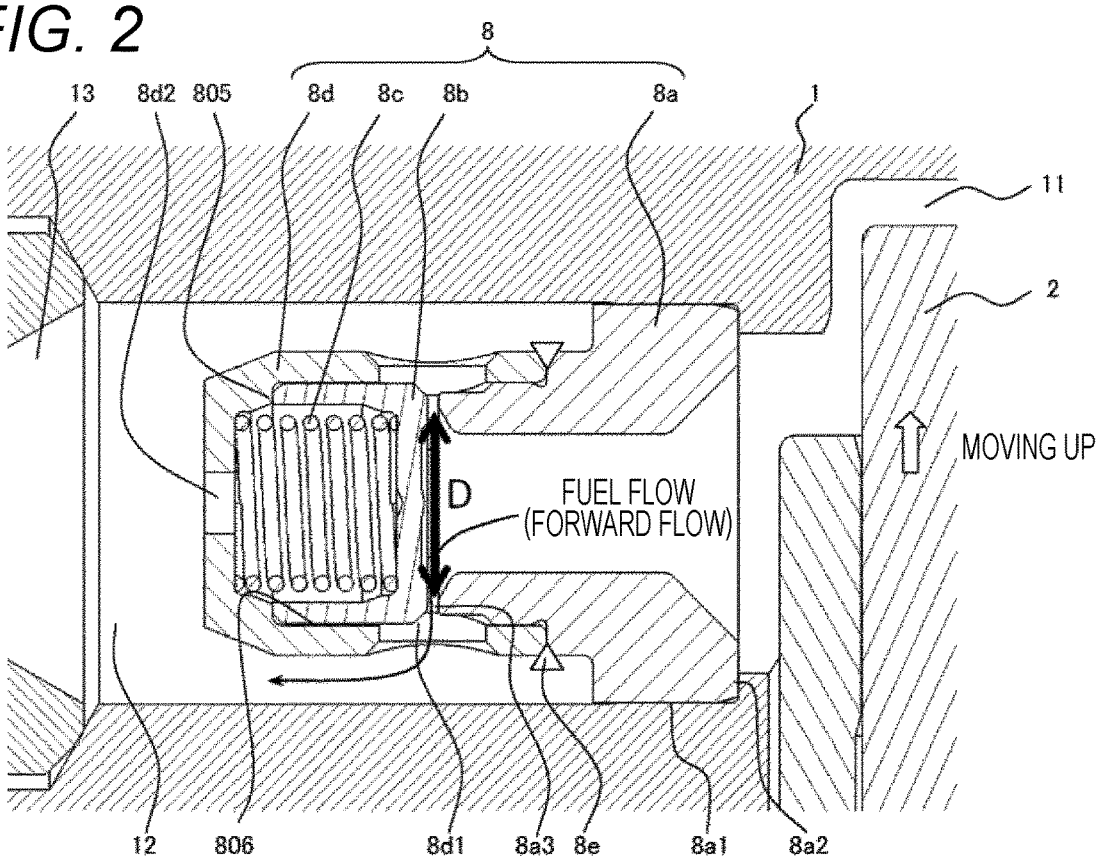
FIG. 2 is a longitudinal sectional view of a discharge valve mechanism in a discharge process according to the embodiment of the present invention.
Figure 3:
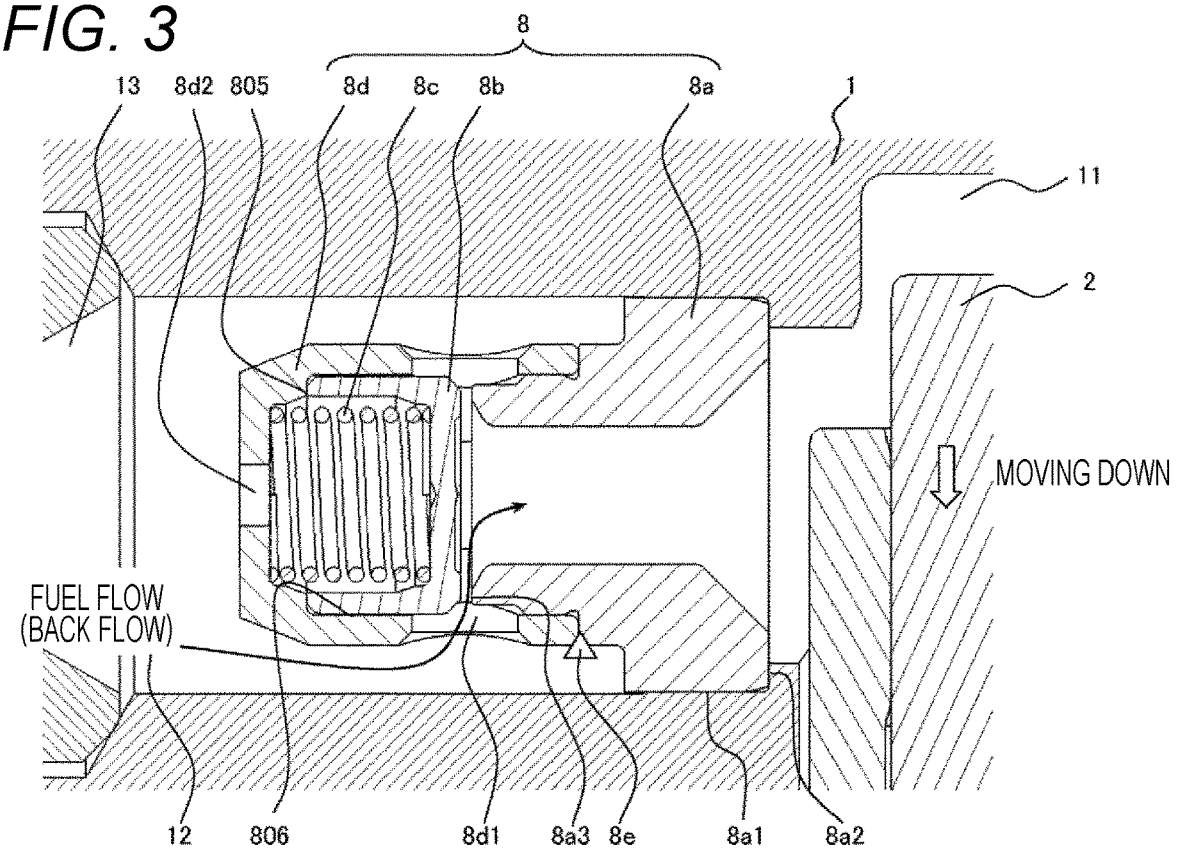
FIG. 3 is a longitudinal sectional view of the discharge valve mechanism in a suction process according to the embodiment of the present invention.

Next, a configuration of the discharge valve unit (discharge valve mechanism) 8 used in the high-pressure fuel supply pump according to the present embodiment will be described with reference to FIGS. 2 and 3. FIG. 2 is an enlarged view of a portion of the discharge valve mechanism (compression process state), and FIG. 3 is an enlarged view of the portion of the discharge valve mechanism (suction process state).

The discharge valve unit (discharge valve mechanism) 8 is provided at the outlet of the pressurizing chamber 11. The discharge valve unit (discharge valve mechanism) 8 consists of the valve seat member 8*a*, the discharge valve member 8*b*, the discharge valve spring 8*c*, and the valve holding member 8*d* as a discharge valve stopper. First, the discharge valve unit (discharge valve mechanism) 8 is assembled by performing laser welding on a welding portion 8*e* outside the pump housing 1. Then, the assembled discharge valve unit (discharge valve mechanism) 8 is press-fitted to the pump housing 1 from the left side in the drawing, and is fixed by a press-fit portion 8*a*1. When the press-fit is performed, a mounting jig is brought into contact with a load receiving portion 8*a*2 formed as a stepped surface portion having a diameter larger than that of the welding portion 8*e*, and is pushed to the right side in the drawing to be press-fitted and fixed in the pump housing 1.

A passage 8*d*2 is provided at the discharge-side tip of the valve holding member 8*d*. Therefore, in the discharge valve unit (discharge valve mechanism) 8, in a state where there is no fuel pressure difference between the pressurizing chamber 11 and a discharge port 12, the discharge valve member 8*b* is pressed against a seat surface 8*a*3 of the valve seat member 8*a* by the biasing force of the discharge valve spring 8*c*, and is in a seated state (valve closed state). When the fuel pressure inside the pressurizing chamber 11 becomes larger than the valve opening pressure of the discharge valve spring 8*c* by more than the fuel pressure of the discharge port 12, the discharge valve member 8*b* resists the discharge valve spring 8*c* and opens as illustrated in FIG. 2, and the fuel inside the pressurizing chamber 11 is discharged to the common rail 23 through the discharge port 12. At this time, the fuel passes through one or a plurality of passages 8*d*1 provided in the valve holding member 8*d*, and is pressure-fed from the pressurizing chamber 11 to the discharge port 12. Subsequently, when the sum of the fuel pressure of the discharge port 12 and the force of the discharge valve spring 8*c* becomes larger than the fuel pressure inside the pressurizing chamber 11, the discharge valve member 8*b* closes as before. This makes it possible to close the discharge valve member 8*b* after the high-pressure fuel discharge.

When the discharge valve member 8*b* is opened, it comes into contact with the stopper 805 provided on the inner peripheral portion of the valve holding member 8*d*, and its movement is restricted. Therefore, the stroke of the discharge valve member 8*b* is appropriately determined by the stopper 805 provided on the inner peripheral portion of the valve holding member 8*d*. Further, when the discharge valve member 8*b* repeatedly opens and closes, it is guided by the inner peripheral surface 806 of the valve holding member 8*d* so that the discharge valve member 8*b* moves only in the stroke direction.

With the configuration described above, the discharge valve unit (discharge valve mechanism) 8 serves as the check valve that restricts the fuel flowing direction.

Next, a characteristic configuration of the discharge valve unit (discharge valve mechanism) 8 according to the present embodiment will be described.

As illustrated in FIG. 2, the discharge valve member 8*b* resists the discharge valve spring 8*c* and opens, and the fuel inside the pressurizing chamber 11 is discharged to the common rail 23 through the discharge port 12. Further, as illustrated in FIG. 3, after the fuel pressurized in the pressurizing chamber 11 is discharged, the plunger moves down and the fuel pressure inside the pressurizing chamber 11 decreases at once. Subsequently, when the sum of the fuel pressure of the discharge port 12 and the force of the discharge valve spring 8*c* becomes larger than the fuel pressure inside the pressurizing chamber 11, the discharge valve member 8*b* closes. However, in a case where spring force F of the discharge valve spring is insufficient, the valve cannot be closed promptly after the fuel is discharged from the discharge port. As a consequence, the high-pressure fuel discharged to the common rail side flows backward to the pressurizing chamber 11 in which the fuel pressure decreases, which may raise a problem that a desired fuel discharge amount cannot be discharged.

In view of the above, according to the present embodiment, with respect to the discharge valve including the discharge valve 8*b* disposed on the discharge side of the pressurizing chamber 11, the discharge valve seat 8*a* that closes a flow passage on the discharge side of the pressurizing chamber 11 by the discharge valve 8*b* being seated, and the discharge valve spring 8*c* that presses the discharge valve toward the discharge valve seat 8*a*, a coefficient K is defined by dividing the spring force F at the time of setting the discharge valve spring 8*c* by a minimum seat diameter D specified by the discharge valve member 8*b* and the valve seat member 8*a* (=spring force F at the time of setting the discharge valve spring 8*c*/minimum seat diameter D). By defining this coefficient, a lower limit of the spring force F can be specified. As the minimum seat diameter D becomes larger, a flow velocity of the fuel becomes slower so that cavitation becomes less likely to occur. Meanwhile, it is desirable to set the minimum seat diameter D small in order to reduce a backflow amount. The backflow amount and the cavitation can be reduced by setting the minimum seat diameter D at a balance in which K becomes 0.2 or more. Details will be described below with reference to FIGS. 4 and 5.

As illustrated in FIGS. 2 and 3, in the present embodiment, the discharge valve seat member 8*a* forming the discharge valve seat 8*a* is disposed on the side of the pressurizing chamber 11 relative to the discharge valve, and the discharge valve spring 8*c* presses the discharge valve 8*b* toward the pressurizing chamber 11 side. Moreover, descriptions will be made using the high-pressure fuel supply pump having a structure in which the discharge valve unit (discharge valve housing) 8 disposed on the outer peripheral side of the discharge valve 8*b* is provided and the discharge valve housing 8 holds the discharge valve spring 8*c* on the side opposite to the discharge valve seat 8*a* relative to the discharge valve 8*b*. However, it is not limited to such a structure.

Figure 4:
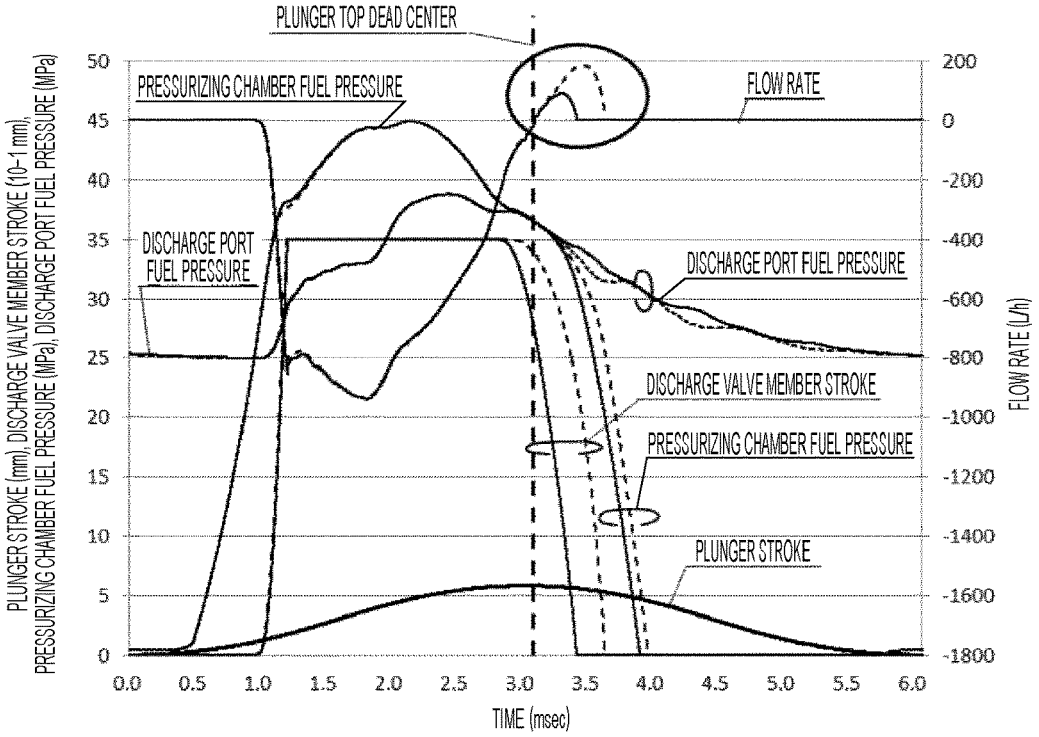
FIG. 4 is behavior of a plunger for one reciprocation during operation of the high-pressure fuel supply pump in which a plunger repeats vertical reciprocation according to the embodiment of the present invention.

FIG. 4 is a graph illustrating behavior of the plunger 2 for one reciprocation during operation of the high-pressure fuel supply pump in which the plunger 2 repeats vertical reciprocation by the cam of the internal combustion engine, which is obtained by fluid analysis. A series of operations from the valve opening to the valve closing of the discharge valve member 8*b* will be described with reference to FIG. 4.

The horizontal axis represents time, and the vertical axis represents a plunger stroke, a discharge valve member stroke, a fuel pressure of the pressurizing chamber, a fuel pressure of the discharge port, and a flow rate. In order to compare change in the movement of the discharge valve using a value of K, the solid line in the drawing illustrates a waveform of a case where the coefficient K is 0.30, and the dotted line illustrates a waveform of a case where the coefficient K is 0.11.

First, a position of the plunger 2 will be described. FIG. 4 illustrates a case of a combination with the cam of the internal combustion engine in which the stroke of the plunger 2 is 0 mm at the bottom dead center of the plunger 2 and 5.8 mm at the top dead center thereof. Assuming that the plunger 2 is positioned at the bottom dead center when it is positioned at 0 second on the horizontal axis of the graph, the plunger 2 is positioned at the top dead center when it is positioned at the point of 3 msec. Subsequently, when it reaches 6 msec, the plunger 2 returns to the bottom dead center again. Since the plunger 2 moves according to the shape of the cam, a vertical reciprocation speed of the plunger 2 is not constant. Even when the coefficient K is different, the position of the plunger 2 is not affected.

Next, the stroke of the discharge valve member 8*b* will be described. When the fuel pressure inside the pressurizing chamber 11 becomes larger than the fuel pressure of the discharge port 12 and the valve opening pressure of the discharge valve spring 8*c*, the discharge valve member 8*b* starts opening the valve. The stroke of the discharge valve member 8*b* starts to increase, and the stroke of the discharge valve member 8*b* reaches the maximum value at the time point in which it comes into contact with the stopper 805 provided on the inner peripheral portion of the valve holding member 8*d*. Note that the stroke of the discharge valve member 8*b* is set to 0.35 mm in the high-pressure fuel supply pump illustrated in FIG. 4.

Next, a process in which the discharge valve member 8*b* starts the valve closing operation from a full stroke state will be described. The condition under which the discharge valve member 8*b* opens is expressed by Mathematical Formula 1, and the condition under which the discharge valve member 8*b* closes is expressed by Mathematical Formula 2.

Pressurizing chamber fuel pressure>Discharge port fuel pressure+Discharge valve spring (Mathematical Formula 1)

Pressurizing chamber fuel pressure<Discharge port fuel pressure+Discharge valve spring (Mathematical Formula 2)

The discharge valve member 8*b* in the full stroke state shifts to the valve closing operation from the time point at which the condition of Mathematical Formula 1 is satisfied. By referring to FIG. 4, it is understood that the valve closing operation starts slightly before the top dead center of the plunger 2. Since the moving direction of the vertical reciprocation of the plunger 2 changes at the top dead center, a rising speed decreases toward the top dead center, and the fuel pressure inside the pressurizing chamber 11 gradually decreases from the maximum value. The difference between the fuel pressure inside the pressurizing chamber 11 and the fuel pressure of the discharge port then becomes small, and the valve closing operation starts at the time point at which the spring force of the discharge valve spring 8*c* exceeds the fuel pressure difference. Accordingly, it is also understood that the timing at which the discharge valve member 8*b* shifts from the valve-open state to the valve-closed state at the full stroke is dominated by the spring force of the discharge valve spring 8*c*.

Here, comparing the cases where K is 0.11 and 0.30, it is understood that the stroke ends earlier in the case where K is 0.30. This is considered to be because the spring force of the discharge valve spring is set strongly and the spring has been able to return to the valve closing position promptly. It has been indicated that the valve opening/closing timing can be accurately controlled using the value of K.

Next, a pressurizing chamber internal fuel pressure and the discharge port fuel pressure will be described. The pressurizing chamber internal fuel pressure indicates the fuel pressure inside the pressurizing chamber 11. By the plunger 2 moving from the bottom dead center to the top dead center, the fuel inside the pressurizing chamber 11 is compressed, and the fuel pressure increases. In the vicinity of the top dead center, the plunger 2 has substantially the same fuel pressure as the discharge port pressure, and the fuel pressure decreases as the plunger 2 moves down.

A set pressure of the common rail 23 on the internal combustion engine side is set as a basic pressure (25 MPa in the case of the high-pressure pump illustrated in FIG. 4) of the discharge port pressure. The pressurized fuel inside the pressurizing chamber 11 is discharged to the discharge port side at the time point at which the pressurizing chamber internal fuel pressure exceeds the discharge port pressure due to the rise of the plunger 2. As the plunger 2 moves from the top dead center to the bottom dead center, the discharge port pressure drops to the set pressure 25 MPa of the common rail 23 due to the stop of the discharge of the pressurized fuel inside the pressurizing chamber 11 or the fuel injection from the injector 24.

As illustrated in FIG. 4, comparing the case where K is 0.11 with the case where K is 0.30, the fuel pressure decreases slightly faster in the case where K is 0.30. This is considered to be because the discharge valve spring 8*c* is strong and the discharge valve 8*b* is promptly closed after the discharge of the fuel is finished.

Next, the fuel discharge amount and the backflow amount of the present high-pressure fuel supply pump will be described. The fuel discharge starts simultaneously with the opening of the discharge valve 8*b*, and the fuel is continuously discharged from the discharge valve 8*b* as long as the condition expressed by Mathematical Formula 1 is satisfied. The timing at which the fuel discharge ends is the time point at which the pressurizing chamber internal fuel pressure and the discharge port fuel pressure become the same fuel pressure.

When the plunger 2 is positioned at the top dead center, the stroke of the discharge valve member 8*b* is still close to the full stroke. While the plunger 2 moves beyond the top dead center and moves downward to the bottom dead center, a state in which the discharge port fuel pressure is larger than the pressurizing chamber internal fuel pressure continues to be established. The discharge valve member 8*b* is in the process of closing the valve despite the fact that the fuel pressure inside the pressurizing chamber becomes smaller than the pressure of the fuel discharged to the discharge port 12, whereby the fuel on the discharge port 12 side flows back into the pressurizing chamber 11 until the valve is completely closed.

In FIG. 4, the flow rate is represented by the second Y-axis, and a negative flow rate value smaller than 0 indicates the discharge of the fuel from the pressurizing chamber 11 toward the discharge port 12 while a positive flow rate value larger than 0 indicates the back flow from the discharge port 12 toward the pressurizing chamber 11.

When the flow rate change at the time point at which the plunger moves from the top dead center to the bottom dead center is compared between the cases where K is 0.11 and 0.30, there is a difference of the fuel backflow amount after the top dead center (portion surrounded by the circle), and it is understood that the backflow amount is smaller in the case where K is 0.30 than the case where K is 0.11. In the case where K is 0.11, since the force of the discharge valve spring 8*c* is small, the closing of the discharge valve 8*b* is delayed, whereby the backflow amount is large. When the minimum seat diameter D is set large, a flow passage area of the fuel also increases at the same time. Therefore, even though the valve opening time of the discharge valve is the same, the discharge amount and the backflow amount vary depending on the magnitude of the minimum seat diameter D. A large backflow amount mainly contributes to reduction of the efficiency of the high-pressure fuel supply pump.

Meanwhile, in the case where K is 0.30, an appropriate spring force is provided and the backflow amount is reduced. Further, by setting the minimum seat diameter D to be small, the flow passage area provided in the discharge valve is narrowed. Therefore, even though the valve opening time of the discharge valve is the same, the discharge amount and the backflow amount vary depending on the magnitude of the minimum seat diameter D.

As can be seen from this result, since the timing at which the discharge valve member 8*b* shifts from the valve-open state to the valve-closed state at the full stroke is dominated by the discharge valve spring force in the present high-pressure fuel supply pump, the discharge valve spring force F is defined by the above-described coefficient K and the coefficient K is further increased, whereby the discharge valve member 8*b* starts the valve closing operation at an earlier timing.

As a result, the timing of completely closing the valve can be made earlier, and the condition expressed by Mathematical Formula 3 is satisfied.

Pressurizing chamber internal fuel pressure<Discharge port fuel pressure (Mathematical Formula 3)

By reducing the time during which the fuel on the discharge port 12 side can flow back into the pressurizing chamber 11, the fuel amount that flows back from the discharge port 12 side into the pressurizing chamber 11 can be reduced. The influence of the value of K on the discharge has been described.

Figure 5:
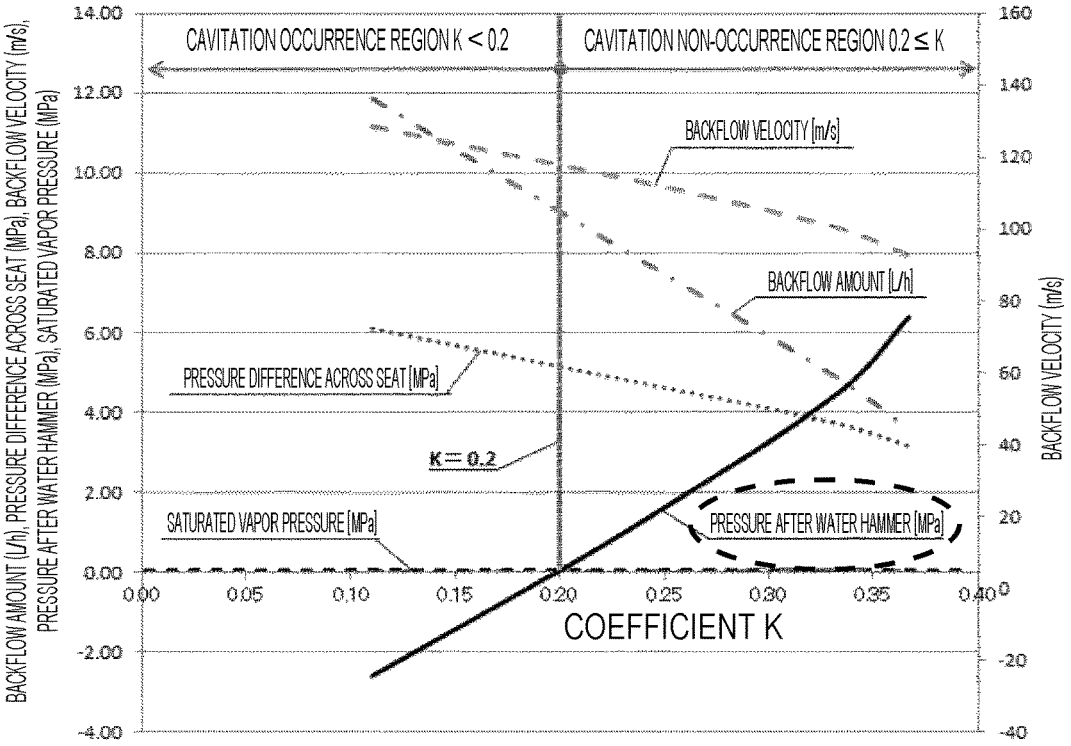
FIG. 5 illustrates a relationship of a coefficient K according to the embodiment of the present invention.

Hereinafter, the coefficient K will be described with reference to FIG. 5. In FIG. 5, the horizontal axis represents the coefficient K, and the vertical axis represents the backflow amount, a pressure difference across the discharge valve seat (pressure difference between the fuel pressure of the discharge port 12 and the fuel pressure of the pressurizing chamber 11 immediately before the discharge valve member 8*b* is closed), a backflow velocity (backflow velocity immediately before the discharge valve member 8*b* is closed), a pressure after a water hammer (pressure after a water hammer on hydraulics caused by the closing of the valve with respect to the fuel flowing backward, pressure locally decreased due to a water hammer in the vicinity of the valve seat member 8*a* inside the pressurizing chamber 11), and a saturated vapor pressure.

First, the backflow amount will be described. As described above, the backflow is a phenomenon that the fuel discharged from the pressurizing chamber through the discharge valve returns to the pressurizing chamber side as the pressure of the pressurizing chamber side becomes low. The backflow amount indicates the amount of the fuel flowing backward from the discharge side to the pressurizing chamber side. By referring to FIG. 5, it is understood that the backflow amount decreases as the value of K increases. As described in the descriptions of FIG. 4, when the value of K is increased, the spring force F of the discharge valve is increased and the minimum seat diameter D is decreased so that the balance is adjusted. Therefore, when the spring force F of the discharge valve is increased, the discharge valve closes promptly, and the backflow amount decreases. Further, by decreasing the magnitude of the minimum seat diameter D, the flow passage area through which the fuel flows back to the pressurizing chamber side can be made small, whereby the backflow amount is decreased.

Next, the backflow velocity in FIG. 5 will be described. In order to suppress cavitation, a backflow velocity (ΔV) of the fuel immediately before the valve is closed needs to be controlled not to become too fast. For that purpose, it is necessary to close the valve corresponding to the downward movement speed of the plunger 2, and it is desirable to close the discharge valve member 8*b* as quickly as possible immediately after the discharge is finished.

The larger ΔV is, the more easily the cavitation (bubble nucleus) tends to occur in the liquid. When the cavitation collapses, significantly high energy is instantaneously generated, and when this collides with a hard metal surface, erosion occurs. Therefore, ΔV is preferably made small.

Next, the pressure difference across the discharge valve seat will be described. When the pressure difference across the seat, which is a differential pressure between the fuel pressure of the discharge port 12 and the fuel pressure of the pressurizing chamber 11 immediately before the discharge valve member 8*b* is closed, is large with respect to a minute gap between the discharge valve member 8*b* and the valve seat member 8*a* immediately before the discharge valve member 8*b* is closed, the flow velocity ΔV increases, whereby pressure decrease ΔP becomes large. As ΔP increases, cavitation tends to occur, which may cause a problem that erosion tends to occur in the seat portion.

Next, the pressure after the water hammer will be described. The pressure after the water hammer is a pressure reduced by the water hammer in the vicinity of the valve seat member 8*a* inside the pressurizing chamber 11. The pressure decrease ΔP caused by the water hammer can be calculated as expressed by Mathematical Formula 4.

$$\Delta P=(a/g)\times\Delta V \quad \text{(Mathematical Formula 4)}$$

In Mathematical Formula 4, a pressure wave propagation speed is denoted by a, gravitational acceleration is denoted by g, and the backflow velocity immediately before the discharge valve member 8*b* is closed is denoted by ΔV. The pressure wave propagation speed a and the gravitational acceleration g are constant values, and the pressure decrease ΔP due to the water hammer changes depending only on ΔV.

The pressure after the water hammer illustrated in FIG. 5 is a value obtained by subtracting the pressure decrease ΔP from the fuel pressure inside the pressurizing chamber 11. When the pressure after the water hammer falls below the saturated vapor pressure of the fuel, cavitation occurs, and when the cavitation collapses, what is called cavitation erosion occurs that causes damage to the discharge valve member 8*b* and the valve seat member 8*a* in the vicinity. When the discharge valve member and the valve seat member are further damaged, a gap is formed between the discharge valve member 8*b* and the valve seat member 8*a* even when the discharge valve member 8*b* is closed, whereby a risk in which the fuel cannot be sealed even when the discharge valve member 8*b* is closed may be caused. Here, as a result of the calculation, it is understood that the pressure after the water hammer exceeds the saturated vapor pressure when the value of K is set to be 0.2 or more. Therefore, by adjusting the spring force F of the discharge valve spring and the minimum seat diameter D so that the coefficient K becomes 0.2 or more, occurrence of cavitation due to the pressure decrease caused by the occurrence of the water hammer can be suppressed. Further, since the back-flow of the fuel of the high-pressure pump can be suppressed by setting K to be 0.2 or more, whereby a desired amount of the fuel can be discharged to the common rail side.

Since the discharge valve spring 8*c* is disposed surrounded by the discharge valve holding member 8*d* and the discharge valve 8*b*, wear tends to occur. In order to prevent wear, it is preferable to perform nitriding treatment so that the discharge valve spring has a nitrided layer on the surface thereof. With this treatment being applied, the surface of the discharge valve spring is hardened, and the wear can be prevented.

Further, in a high-pressure fuel supply pump of a normally opened type (in which a valve is opened in a deenergized state) in which a suction valve and a rod are provided separately, spring force of a discharge valve spring is set to be smaller than a spring force of a spring pressing the suction valve in the direction opposite to a pressurizing chamber from the viewpoint of fail-safe. This is for the purpose of continuing to send fuel to a combustion chamber so as not to stop suddenly even when a high-pressure pump stops moving.

Using the present invention, since the high-pressure fuel supply pump uses the power of the internal combustion engine, fuel consumption can be further improved by using a high-pressure pump with high combustion efficiency, which also results in a reduction in $CO_2$ emissions.

It should be noted that the present invention is not limited to the high-pressure pump with numerical values described in the embodiment. The present invention is not limited to the high-pressure fuel supply pump of the internal combustion engine, and can be widely used for various high-pressure pumps.

REFERENCE SIGNS LIST

1 pump housing
2 plunger
8 discharge valve unit (discharge valve mechanism)
8*a* valve seat member
8*b* discharge valve member
8*c* discharge valve spring
8*d* valve holding member
8*e* welding portion
8*h* inclined portion
8*a*1 press-fit portion
8*a*2 load receiving portion
8*a*3 seat surface
8*a*4 step
8*d*1 passage provided on valve holding member
9 pressure pulsation reduction mechanism
10*c* suction passage
11 pressurizing chamber
13 discharge port
20 fuel tank
23 common rail
24 injector
26 pressure sensor
27 ECU
30 electromagnetic suction valve mechanism
805 stopper
806 interior wall of the valve holding member

The invention claimed is:

1. A high-pressure fuel supply pump, comprising:
a discharge valve disposed on a discharge side of a pressurizing chamber;
a discharge valve seat that closes a discharge side flow passage of the pressurizing chamber by seating the discharge valve; and
a discharge valve spring that presses the discharge valve toward the discharge valve seat, wherein
in a case where a minimum seat diameter of a seat portion in which the discharge valve is seated on the discharge valve seat is given by a variable D and a spring force of the discharge valve spring at a time of setting is given by a variable F, a coefficient K obtained by dividing the variable F by the variable D is set to be 0.2 or more.

2. The high-pressure fuel supply pump according to claim 1, wherein
at least a portion of the discharge valve seat is disposed on a pressurizing chamber side relative to the discharge valve, and
the discharge valve spring presses the discharge valve toward the pressurizing chamber side.

3. The high-pressure fuel supply pump according to claim 1, further comprising:
a discharge valve housing disposed on an outer peripheral side of the discharge valve, wherein
the discharge valve housing holds the discharge valve spring on a side opposite to the discharge valve seat relative to the discharge valve.

4. The high-pressure fuel supply pump according to claim 1, wherein
the coefficient K is determined such that a fuel pressure generated on the discharge side of the pressurizing chamber becomes a value equal to or more than a saturated vapor pressure of fuel after the discharge valve is closed.

5. The high-pressure fuel supply pump according to claim 1, wherein
the discharge valve spring has a nitrided layer on its surface.

6. The high-pressure fuel supply pump according to claim 1, wherein
the spring force of the discharge valve spring is made smaller than a spring force of a suction valve biasing spring that presses a suction valve for sucking fuel in a direction opposite to the pressurizing chamber.

* * * * *